United States Patent [19]

Wada et al.

[11] 4,263,777

[45] Apr. 28, 1981

[54] MULTI-LAYERED BULKY SPUN YARN AND A PROCESS FOR MANUFACTURING THE SAME

[75] Inventors: Osamu Wada; Goro Murata, both of Takatsuki, Japan

[73] Assignee: Teijin Limited, Osaka, Japan

[21] Appl. No.: 100,515

[22] Filed: Dec. 5, 1979

[30] Foreign Application Priority Data

Dec. 15, 1978 [JP] Japan ..... 53-154110

[51] Int. Cl.[3] ..... D02G 3/24; D02G 3/04; D02G 3/36

[52] U.S. Cl. ..... 57/227; 57/12; 57/230; 57/254; 57/255; 57/253

[58] Field of Search ..... 57/3, 6, 12, 227, 230, 57/228, 253, 254, 255, 256

[56] References Cited

U.S. PATENT DOCUMENTS

| | | | |
|---|---|---|---|
| 3,387,450 | 6/1968 | Brown | 57/227 |
| 3,852,948 | 12/1974 | Ruddell et al. | 57/255 X |
| 3,965,663 | 6/1976 | Goetti et al. | 57/256 |
| 3,994,122 | 11/1976 | Shah | 57/254 X |

*Primary Examiner*—John Petrakes

*Attorney, Agent, or Firm*—Burgess, Ryan and Wayne

[57] ABSTRACT

A roving formed from a first kind of staple fibers, each of which is at least 3 denier, is interposed with a randomly mixed sliver formed from a second kind of staple fibers, each of which is between 1.5 denier and 3 denier, and a third kind of staple fibers, each of which is at most 1.5 denier, the thermal shrinkage of the second kind of staple fibers being higher than that of the third kind of staple fibers. The roving and the randomly mixed sliver are twisted together so that the sliver wraps around the roving in order to form a double layered roving. After the double layered roving is subjected to fine spinning, it is then subjected to a heat treatment. As a result, a multi-layered bulky spun yarn is obtained.

16 Claims, 13 Drawing Figures

MULTI-LAYERED BULKY SPUN YARN AND A PROCESS FOR MANUFACTURING THE SAME

BRIEF DESCRIPTION OF THE INVENTION

The present invention relates to a multi-layered bulky spun yarn comprising at least three kinds of staple fibers which vary in denier. The present invention also relates to a process for manufacturing a multi-layered bulky spun yarn.

BACKGROUND OF THE INVENTION

Many bulky spun yarns have conventionally been obtained by a process wherein two or more staple fibers having different thermal shrinkages are mixed and subjected to a heat treatment after a yarn is formed. According to this method, since the staple fibers having a high thermal shrinkage have a tendency to concentrate at the central portion of the spun yarn, the spun yarn thus obtained has a disadvantage in that it lacks softness, more specifically the conventional spun yarn lacks handle of bulkiness and is not provided with rich and well formed feeling. If fine fibers are used to eliminate the above-mentioned disadvantage, there results another disadvantage in that the textile obtained from the spun yarn lacks stiffness or springiness. In other words, the thus obtained textile lacks liveliness. In addition, as a result of the concentration in the spun yarn of fibers having high thermal shrinkage the fibers having low thermal shrinkage move toward the outside of the spun yarn, and during the movement of the fibers the alignment of the fibers having low thermal shrinkage is randomly disturbed. Accordingly, this produces disadvantage in that the hand of the obtained spun yarn is rough and harsh.

SUMMARY OF THE INVENTION

An object of the present invention is to provide a cashmere-like spun yarn which is free from the above-mentioned disadvantages and which has a surface with a soft touch, and the textile made of such yarn has handle of bulkiness, and rich and well formed feeling and is stiff and springy.

The object of the present invention is accomplished by a bulky spun yarn comprising at least three kinds of staple fibers which vary in denier and are coaxially layered about the axis of the spun yarn. A first kind of staple fibers, each of which is the largest in denier is located at the core portion of the spun yarn so as to constitute an innermost portion. A second kind of staple fibers, each of which is smaller in denier than that of the first kind of staple fibers, surrounds the innermost portion in order to constitute an intermediate portion. A third kind of staple fibers, each of which is the smallest in denier, surrounds the intermediate portion in order to constitute an outermost portion.

In a preferred embodiment of the present invention, the first kind of staple fibers is at least 3 denier, the second kind of staple fibers is between 1.5 denier and 3 denier, and the third kind of staple fibers is at most 1.5 denier.

In another preferred embodiment of the present invention, the innermost portion may be constituted of at least two kinds of staple fibers which vary in denier. In a desirable embodiment, each fiber in a first part of the first kind of staple fibers located at the innermost portion of the spun yarn is at least 3 denier and has a modified cross section, and each fiber in a second part of the first kind of staple fibers located just outside of the innermost portion is at least 3 denier but is smaller than that of the first part of the first kind of staple fibers. Each fiber in the second kind of staple fibers is at most 4 denier and has a modified cross section. The third kind of staple fibers is constituted of very fine fibers, each of which is at most 1.5 denier.

According to another aspect of the present invention, a process for manufacturing a bulky spun yarn comprising at least three kinds of staple fibers which vary in denier and which are coaxially layered about the axis of the spun yarn is proposed. In this process, during a roving operation, a roving which comprises a first kind of staple fibers, each of which is the largest in denier, is supplied onto a randomly mixed sliver so as to be interposed with the randomly mixed sliver. The sliver comprises a second kind of staple fibers, each of which is smaller in denier than that of the first kind of staple fibers and a third kind of staple fibers, each of which is the smallest in denier, and the thermal shrinkage of the second kind of staple fibers is higher than that of the third kind of staple fibers. The roving is then twisted about the axis thereof so that the randomly mixed sliver is wrapped around the roving to form a double layered roving. After the double layered roving is subjected to a fine spinning operation, the fine spun yarn thus obtained is subjected to a heat treatment.

In a preferred embodiment of the present invention, each fiber in the first kind of staple fibers is at least 3 denier, each fiber in the second kind of staple fibers in the randomly mixed sliver is between 1.5 denier and 3 denier and each fiber in the third kind of staple fibers is at most 1.5 denier.

In another preferred embodiment of the present invention, the thermal shrinkage in boiling water of the second kind of staple fibers is at least 3 percent higher than the thermal shrinkage of the third kind of staple fibers.

In a still further preferred embodiment of the present invention, the first kind of staple fibers comprises at least two parts of staple fibers which vary in their thermal shrinkage properties. It is desirable that the roving comprises a first part of staple fibers, each of which is at least 3 denier and has a modified cross section, and a second part of staple fibers, each of which is at least 3 denier but is smaller than that of the first part, and the thermal shrinkage of the first part of staple fibers is higher than that of the second part of staple fibers. Each fiber in the second kind of staple fibers constituting the randomly mixed sliver is at most 4 denier and has a modified cross section, and each fiber in the third kind of staple fibers, also constituting the randomly mixed sliver, is at most 1.5 denier, and the thermal shrinkage of the second kind of staple fibers is smaller than that of the third kind of staple fibers.

It is preferable that the fine spun yarn be subjected to a heat treatment in a dry condition at a temperature between 130° C. and 200° C. or in a wet condition at a temperature between 80° C. and 130° C.

BRIEF DESCRIPTION OF THE DRAWINGS

Some embodiments of the present invention will be explained hereinbelow in detail with reference to the accompanying drawings, wherein.

DETAILED DESCRIPTION OF THE INVENTION

Figure 1A:
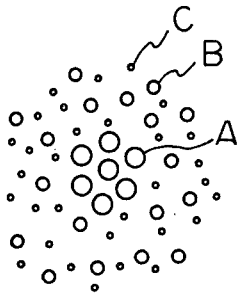
FIGS. 1A and 1B are diagrammatical cross sectional views of a multi-layered bulky spun yarn according to the present invention and illustrate conditions before and after the yarn is subjected to a heat treatment, respectively.
Figure 1B:
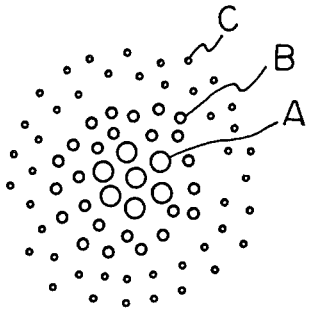

A spun yarn according to the present invention has a multi-layered construction which comprises staple fibers located at the outermost portion, staple fibers located at the intermediate portion and staple fibers located at the innermost portion and which is a bulky spun yarn. The cross sectional distribution of fibers in the multi-layered spun yarn of the present invention is illustrated in FIGS. 1A and 1B, wherein symbol A designates a first kind of staple fibers, each of which is at least 3 denier, symbol B designates a second kind of staple fibers, each of which is between 1.5 denier and 3 denier, and symbol C designates a third kind of very fine staple fibers, each of which is at most 1.5 denier. FIG. 1A is a cross sectional view of a spun yarn of the present invention which has not been subjected to a heat treatment, and FIG. 1B is a cross sectional view of a spun yarn of the present invention which has been subjected to a heat treatment.

The staple fibers utilized to obtain a spun yarn of the present invention may be staple fibers which are usable in the spinning industry. However, it is preferable that they be man made fibers, especially synthetic fibers, such as polyester, polyamide or polyacrylic, because they must be very fine fibers or fibers that have a high thermal shrinkage. The requirements of the staple fibers will now be explained in detail.

The staple fibers constituting the innermost portion may be natural fibers, man made fibers or a mixture thereof. The cross sectional shape of the staple fibers is not limited. In other words, the shape of the staple fibers may be a circular shape or a modified cross section, such as a trilobal. Also, the fiber length of the staple fibers is not limited. However, the staple fibers are required to be equal to or more than 3 denier. This is because it is very difficult to obtain a textile having a sufficient stiffness unless staple fibers, each of which is at least 3 denier, are used. If a textile having handle of bulkiness as well as rich and well formed feeling is desired, it is preferable to impart the bulkiness to the staple fibers located at the innermost portion by utilizing staple fibers having good crimpability or by mixing at least two kinds of staple fibers which vary in thermal shinkage. In this case, it is preferable that the difference in the thermal shrinkage be within 10 percent so that the textile thus obtained does not have excessive bulkiness. It is preferable that the blending ratio of the staple fibers located at the innermost portion is between 10% and 40%. If the blending ratio exceeds 40%, it becomes very difficult to prepare a double layered roving as will be explained hereinafter.

It is necessary that the denier of the staple fibers located at the intermediate portion be smaller than the denier of the staple fibers located at the innermost portion, and it is preferable that the denier of the staple fibers located at the intermediate portion be between 1.5 denier and 3 denier. It is understood that the role of the staple fiber constituting the intermediate portion is to prevent the staple fibers located at the innermost portion which is constituted of relatively thick fibers from rising to the surface of the spun yarn after it has migrated. In other words, the staple fibers constituting the intermediate portion ensure the effect of the very fine fibers located at the outermost portion, and as a result the rough and harsh feeling is reduced and soft surface touch is obtained. To establish the above-mentioned effect, it is preferable that the denier of the staple fibers be between 1.5 denier and 3 denier. The inventors of the present invention confirmed that the surface of the spun yarn is rough and harsh when the fibers located at the surface of the spun yarn are not substantially parallel to each other or when the denier of the fibers located at the surface is excessively large. It is desirable that the thermal shrinkage of the staple fibers constituting the intermedite portion be higher than that of the very fine staple fibers located at the outermost portion so that the very fine staple fibers can rise to the surface as much as possible. It is preferable that the blending ratio of the staple fibers located at the intermediate portion be between 25% and 55%. If the blending ratio is less than 25%, it is very difficult to obtain a desired textile, i.e., a knitted or woven fabric having a soft surface touch, because the staple fibers constituting the innermost portion may rise to the surface of the fabric. On the other hand, if the blending ratio exceeds 50%, it is also difficult to obtain a textile having a soft surface touch because the amount of the very fine staple fibers located at the outermost portion becomes relatively small.

It is preferable that the staple fibers constituting the outermost portion be equal to or less than 1.5 denier. If they exceed 1.5 denier, it is very difficult to obtain a spun yarn which provides a textile having a soft surface touch.

The spun yarn of the present invention is characterized in that the various kinds of staple fibers explained above are coaxially arranged to form a multi-layered bulky spun yarn.

The spun yarn of the present invention with a multi-layered structure can be manufactured in the process as set forth below. A roving is previously formed with a first kind of staple fibers, each of which is the largest in denier, preferably at least 3 denier. During a roving operation, the roving is supplied into a randomly mixed sliver so as to be interposed therewith. The randomly mixed sliver comprises a second kind of staple fibers, each of which is smaller in denier than that of the first kind of staple fibers, preferably between 1.5 denier and 3 denier. The randomly mixed sliver further comprises a third kind of staple fibers, each of which is the smallest in denier, preferably at most 1.5 denier, and the thermal shrinkage of the second kind of staple fibers is higher than that of the third kind of staple fibers. Then the roving is twisted so that the randomly mixed sliver is wrapped around the roving to form a double layered roving. After the double layered roving is subjected to a fine spinnning operation, the fine spun yarn is subjected to a heat treatment, and thus a bulky spun yarn of the present invention is obtained.

The method for obtaining very fine staple fibers, each of which is at most 1.5 denier, may be a regular spin draw method. However, as is well known, the method wherein conjugate fibers made of synthetic material and constituted of two elements, i.e. sea and island elements, are spun from a spinneret and then the sea element is dissolved so that very fine fibers are obtained or the method wherein conjugate fibers made of synthetic material are mechanically or chemically split so that very fine fibers are obtained is applicable when extra fine fibers are required.

To obtain the spun yarn of the present invention, it is necessary that the second kind of staple fibers which constitute the intermediate portion and preferably, each of which is between 1.5 denier and 3 denier, has a thermal shrinkage higher than that of the third kind of very fine staple fibers. It is desirable that the difference in the thermal shrinkage be equal to or more than 3%. This is to facilitate the second kind of staple fibers in the roving being shrunk thermally when the double layered roving is subjected to a heat treatment. If the difference in the thermal shrinkage is less than 3%, it is very difficult to obtain a spun yarn which is constructed so that the fine fibers are located at the outermost portion.

Figure 2:
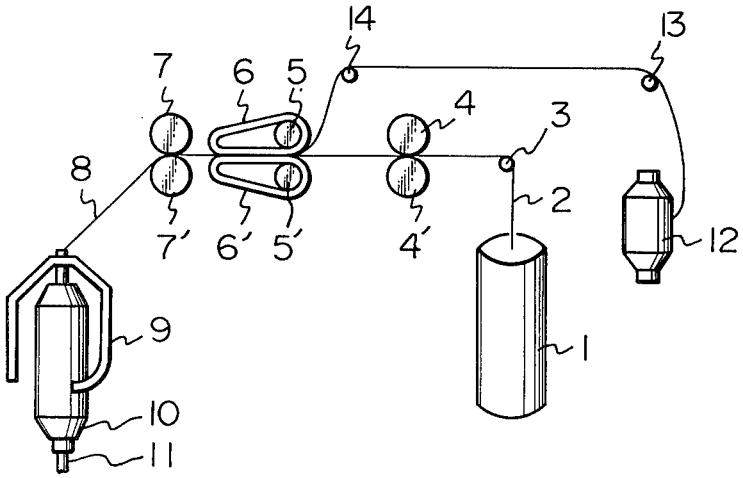
FIG. 2 is a diagrammatical side view illustrating a process wherein a double layered roving for a multi-layered bulky spun yarn of the present invention is manufactured.
Figure 3:
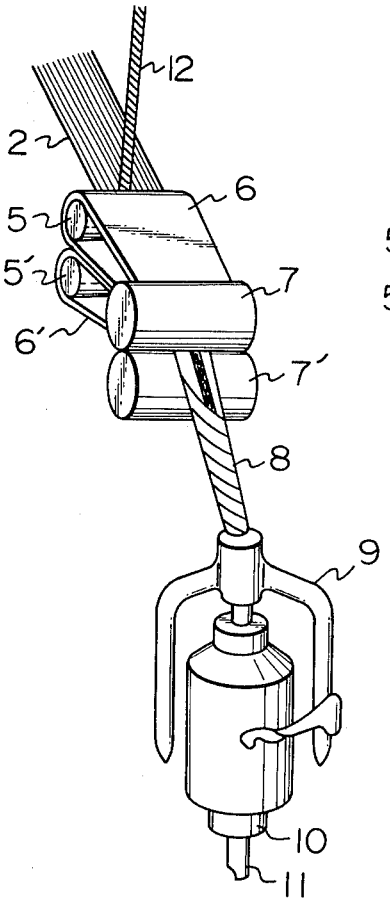
FIGS. 3 and 4 are enlarged perspective views illustrating different mixing portions usable in the process illustrated in FIG. 2.

Methods of the present invention will now be explained with reference to FIGS. 2 through 4. Referring to FIG. 2 wherein a process for obtaining a double layered roving which will result in a multi-layered bulky spun yarn is diagrammatically illustrated, a randomly mixed sliver 2 comprising fine staple fibers, each of which is at most 1.5 denier, and staple fibers, each of which is between 1.5 denier and 3 denier, is withdrawn from a can 1 and is supplied via a guide 3 and a pair of back rollers 4 and 4' to a pair of apron feeders 6 and 6' where it is drafted several times. On the other hand, a roving 12 comprising staple fibers, each of which is at least 3 denier, is supplied via guides 13 and 14 to the apron feeders 6 and 6', where it is interposed with the randomly mixed sliver 2. The roving 12 and the randomly mixed sliver 2 are transferred together by means of a pair of front rollers 7 and 7' and form a double layered roving 8. The double layered roving 8 is twisted by a flyer 9 and then is wound on a bobbin 10 inserted on a rotatable spindle 11. The apron feeders 6 and 6' are wrapped around middle rollers 5 and 5', respectively. FIG. 3 is an enlarged perspective view wherein the mechanism for interposing the roving 12 with the randomly mixed sliver 2 is illustrated. In FIG. 3, the randomly mixed sliver 2 is spread to a certain width, which is usually between 15 mm and 20 mm. The roving 12 having a diameter usually equal to or less than 5 mm is twisted to a rate between 0.4 Turn/25.4 mm and 0.7 Turn/25.4 mm. The roving 12 is supplied at the central portion of the randomly mixed sliver 2 at the entrance of the apron feeders 6 and 6' and is interposed therewith, and then is drafted by the apron feeders 6 and 6'. As soon as the roving 12 and the randomly mixed sliver 2 leave the front rollers 7 and 7', twists are imparted to them by the flyer 9. Accordingly, the randomly mixed sliver 2 wraps around the roving 12, and thus a double layered roving is obtained.

Figure 4:
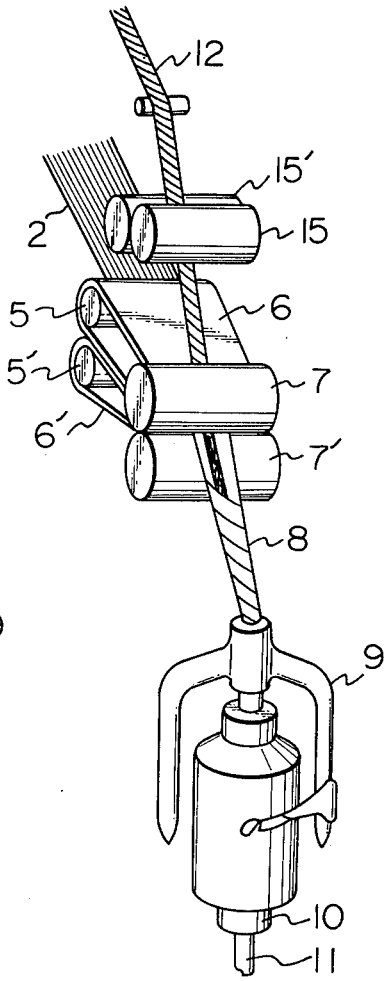

FIG. 4 is a perspective view illustrating an alternative mechanism wherein a spun yarn of the present invention is obtained. In FIG. 4, the roving 12 is supplied to the front rollers 7 and 7' via a pair of supply rollers 15 and 15'. In this case, the draft ratio between the supply rollers 15 and 15' and the front rollers can be different from the draft ratio between the apron feeders 6 and 6' and the front rollers 7 and 7'. Accordingly, by adjusting the draft ratios, the blending ratio of the staple fibers located at the innermost portion can easily be altered at will.

The double layered roving which has been obtained in the foregoing manner is then subjected to a fine spinning operation in accordance with a conventionally well known method. Thereafter, the fine spun roving is subjected to a heat treatment so that the second kind of staple fibers, each of which is between 1.5 denier and 3 denier and has a high thermal shrinkage, is thermally shrunk and so that the first kind of staple fibers, each of which is at least 3 denier, becomes located at the innermost portion, the second kind of staple fibers having a high shrinkage becomes located at the intermediate portion and the third kind of very fine staple fibers, each of which is at most 1.5 denier, becomes located at the outermost portion.

It is preferable that the heat treatment be performed at a temperature between 130° C. and 200° C. under a dry condition or a temperature between 80° C. and 130° C. under a wet condition. The heat treatment may be performed before the spun yarn is knitted or woven or after the spun yarn is knitted or woven. As a result, a spun yarn of the present invention which has a multi-layered construction is obtained. The textile, i.e. a knitted or woven fabric, made of the spun yarn has a soft touch surface and has handle of bulkiness as well as rich and well formed feeling, and it is stiff and springy. More specifically, since the outermost portion of the spun yarn is constituted of very fine staple fibers, each of which is at most 1.5 denier, the textile has a soft surface. It should be noted that if at least three kinds of staple fibers which are completely randomly mixed and which vary in their thermal shrinkages are subjected to a heat treatment to obtain a bulky spun yarn, the parallel staple fibers having low thermal shrinkage is disturbed when the staple fibers having high thermal shrinkage move inward and the staple fibers having low thermal shrinkage move outward, and accordingly, in general, the hand of the obtained spun yarn is rough and harsh. In the spun yarn of the present invention, if the very fine staple fibers, each of which is at most 1.5 denier, are located at the outermost portion, the hand of the spun yarn is not rough or harsh.

Due to the multi-layered construction of the spun yarn of the present invention as illustrated in FIG. 1B, the spun yarn has a handle of bulkiness and a rich and well formed feeling. More specifically, since in general, staple fibers constituting a spun yarn move in the spun yarn while the spun yarn is manufactured, i.e., while it is drafted and twisted, a staple fiber, which is at the central portion of the spun yarn, may be displaced to the peripheral portion of the spun yarn along the lengthwise direction of the spun yarn. In other words, the position of staple fibers is not constant but often varies. If a bulky spun yarn is manufactured by mixing staple fibers having high and low thermal shrinkages and by subjecting them to a heat treatment, due to the thermal shrinkage and migration of the fibers, the staple fibers which vary in denier and thermal shrinkage cannot be effectively separated into layers as well as those in the spun yarn of the present invention. Accordingly, in the conventional spun yarn, the staple fibers having the largest denier cannot be located at the central portion because they are restricted by other staple fibers and the obtained spun yarn does not have handle of bulkiness or rich and well formed feeling.

On the other hand, in a spun yarn of the present invention since the double layered construction is formed between the first kind of staple fibers A constituting the innermost portion and the second and third kinds of staple fibers B and C constituting the intermediate and outermost portions before it is subjected to a heat treatment, the migration of the staple fibers across the layers does not occur easily, and the migration mainly occurs between the second kind of staple fibers B constituting the intermediate portion and the third kind of staple fibers C constituting the outermost portion. As a result, the layers are effectively separated without disturbing the arrangement of the fibers.

Some variations of the present invention will be explained hereinbelow.

To increase smooth, limber and soft feeling of the textile made of a cashmere-like spun yarn of the present invention, it is preferable that the third kind of staple fibers constituting the outermost portion be treated with slickeners. It is desirable from a practical point of view that the slickeners be durable. The slickeners should be selected so that a fiber treated therewith has characteristics similar to that of an animal hair. One of the important characteristics of an animal hair is a frictional characteristic and it is usually observed that the friction coefficient of an animal hair is low when the frictional speed is low and is high when the frictional speed is high. The slickeners which impart such a characteristic to the staple fibers can be classified into two types, i.e., resin type and surfactant type. The resin type slickeners include polysiloxanes, polyethylene and polyester, and the surfactant type slickeners include cationic amine surfactants, quaternary ammonium surfactants, nonionic alcoholic surfactants, polyethylene glycol, anionic sulfated oils, amphoteric betaine surfactants and amino acid surfactants. The slickeners which have durability and smoothness are the resin type and those which have ideal frictional characteristics are polysiloxanes. The polysiloxanes include denaturated siloxanes which are obtained by adding epoxy groups or amino groups to dimethyl vinylpolysiloxanes, polysiloxanes including oxyalkylene, methylbinylpolysiloxanes, methylalkoxypolysiloxanes. It is preferable that the viscosity of the slickeners that are used to equal to or more than 100,000 centistokes at 20° C. The slickeners can be used alone or in combination. The percentage of added slickeners to fibers is usually between 0.1% and 3%.

When their effects to the hand and spinning ability are taken into consideration, only the very fine staple fibers constituting the outermost portion must be treated with the slickeners. Since the treatment with the slickeners is intended to increase the smooth, limber and soft feeling, it is sufficient that the treatment be applied only to the very fine staple fibers constituting the outermost portion. If the treatment is also applied to the staple fibers constituting the intermediate and innermost portions, it adversely affects the handle of bulkiness and rich and well formed feeling.

It is preferable that the treatment with the slickeners be effected to the very fine staple fibers, and then they be mixed with the second kind of staple fibers so as to form randomly mixed sliver in order to increase the spinning ability of the mixed sliver and the double layered roving.

Figure 5A:
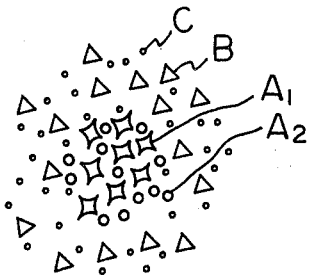
FIGS. 5A and 5B are cross sectional views of another multi-layered bulky spun yarn according to the present invention and illustrate conditions before and after the yarn is subjected to a heat treatment, respectively.
Figure 5B:
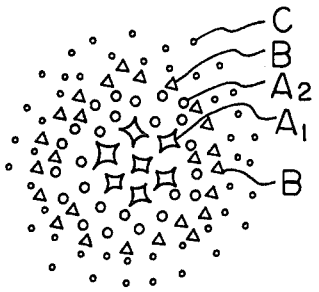

In a variation of the present spun yarn according to the present invention, the innermost portion may be formed from at least two kinds of staple fibers which vary in denier. It is desirable that the first kind of staple fibers located at the innermost portion be divided into two parts, i.e., first and second parts, as illustrated in FIG. 5B. Each fiber $A_1$ in the first part is at least 3 denier and has a modified cross section. Each fiber $A_2$ is located just outside of the first part of fibers $A_1$ and is at least 3 denier but is smaller than that of the first part. The second kind of staple fibers B, each of which is at most 4 denier and has a modified cross section, is located outside of the first kind of staple fibers. The third kind of staple fibers C is constituted of very fine staple fibers, each of which is at most 1.5 denier.

The process for manufacturing such a spun yarn is very similar to that illustrated in FIGS. 2 through 4. However, in this case the roving 12 (FIG. 2) is formed by a mixture of the first part of staple fibers $A_1$ (FIG. 5A) and the second part of staple fibers $A_2$, the thermal shrinkage of the first part of staple fibers $A_1$ being higher than that of the second part of stable fibers $A_2$. It is preferable that the difference in thermal shrinkage in boiling water between fibers $A_1$ and $A_2$ of the first and second parts be at least 3 percent. The roving 12 (FIG. 2) constituted with fibers $A_1$ (FIG. 5A) and $A_2$ of the first and second parts is interposed with the randomly mixed sliver 2 constituted with the second and third kinds of staple fibers B and C, the thermal shrinkage of the second kind of staple fibers B being smaller than that of the third kind of staple fibers C. It is desirable that the difference in thermal shrinkage in boiling water between the second and third kinds of staple fibers B and C also be at least 3 percent. Referring to FIG. 2, the roving 12 and the randomly mixed sliver 12 is drafted and twisted by means of a pair of apron feeders 6 and 6' and a flyer 9 to form a double layered roving, and then is wound on a bobbin 10 inserted onto a rotatable spindle 11. The wound roving is then withdrawn from the bobbin 10 and is then subjected to a fine spinning operation. A cross sectional view of the thus obtained fine spun yarn is illustrated in FIG. 5A, wherein the symbols $A_1$, $A_2$, B and C correspond to the same fibers as in FIG. 5B. When the fine spun yarn is heat treated, a multi-layered bulky spun yarn illustrated in FIG. 5B can be obtained.

Figure 6A:
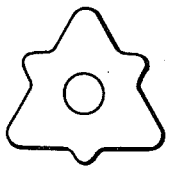
FIGS. 6A through 6F are diagrammatical cross sectional views of modified fibers.
Figure 6B:
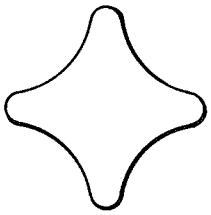
Figure 6C:
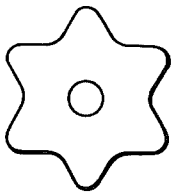
Figure 6D:
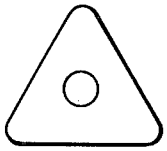
Figure 6E:
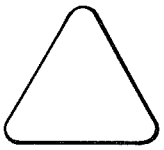
Figure 6F:
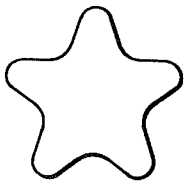

Some examples of the modified cross sections applicable to the first part of staple fibers $A_1$ and the second kind of staple fibers B are illustrated in FIGS. 6A through 6F, wherein in FIG. 6A, a modified hollow trilobal shape is illustrated, in FIG. 6B, a cross shape cross section is illustrated; FIGS. 6C and 6F illustrate star shapes; and FIG. 6D and 6E illustrate hollow and solid trilobal shapes, respectively.

The finishing process of the textile made of a multi-layered bulky spun yarn according to the present invention will now be explained. The testile, i.e., the knitted or woven fabric, is treated through a general finishing process. If necessary, it is also subjected to dyeing, fabric relaxation and scoring, heat set, singeing or shearing operations. It is preferable that the textile made of multi-layered bulky spun yarn of the present invention be subjected to the following two steps.

In a first step, the textile is subjected to a press operation at a temperature between 45° C. and 95° C., desirably between 50° C. and 80° C., and under a pressure between 100 kg/cm$^2$ and 200 kg/cm$^2$, desirably between 110 kg/cm$^2$ and 150 kg/cm$^2$. If the temperature is higher than 95° C., the textile is excessively heat set, and accordingly, the textile becomes paperlike. In other words, the textile does not have a cashmere-like hand because it lacks bulkiness. If the temperature is lower than 45° C., the heat set treatment is unsatisfactory for effecting smoothness in the textile. If the pressure is higher than 200 kg/cm$^2$, the textile becomes paperlike because it is pressed excessively. If the pressure is lower than 100 kg/cm$^2$, the textile does not have an increased smooth, limber and soft feeling because it is not pressed enough. The machine for the pressing operation may be a rotary press, paper press or polisher press. It is preferable that a paper press be used because in the paper press, the textile is pressed for a predetermined long time by means of plane members while it is discontinuously transferred.

In a second step, the pressed textile is overfed into a space formed between a cylinder heated to a temperature between 100° C. and 180° C. and an endless elastic band wrapped around the cylinder. The function of the cylinder and the endless elastic band is the same as that of a cylinder and an endless belt in a conventionally known sanforizing machine. Accordingly, the textile is transferred together with the cylinder and the endless elastic band. The endless elastic band may be made of rubber or felt. The overfeed ratio of the textile may be between 1% and 20%. A high overfeed ratio is applied when a thin material is treated, and, when a thick textile is treated, it is preferable that the overfeed ratio be less than 10%, desirably between 2% and 5%. The cylinder may be heated to a temperature between 100° C. and 180° C. by means of an electric heater, a steam heater or heating medium. If the temperature of the cylinder is lower than 100° C., the heat set effect is unsatisfactory. On the other hand, if the temperature is higher than 180° C., the hand of the textile may be due to the thermal effect.

Some examples of the present invention will now be explained.

EXAMPLE 1

A first kind of polyester staple fibers, each being 6 denier, was used to manufacture a roving which constituted the innermost portion. A second kind of polyester staple fibers, each being 2 denier was mixed with a third kind of polyester staple fibers, each being 0.8 denier, to form a randomly mixed sliver. The roving was interposed with the randomly mixed sliver in a roving frame like that illustrated in FIG. 2, and then it was twisted to form a double layered roving. After the double layered rovings were fine spun, the yarns obtained by the fine spinning were made into two ply yarns, having a metric count of 2/48 S. The two ply yarns were woven to form fabrics, the hands of which were measured by sensual tests. The results obtained thereby are described in Test No. 1 in Table 1. The first kind of staple fibers which had a crimp elasticity percentage of between 50% and 70% was replaced with another kind of staple fibers having a crimp elasticity percentage of 70%, and a textile was manufactured in a manner similar to that explained above. The results obtained thereby are described in Test No. 2 in Table 1. The crimp elasticity percentage is defined as the percentage of the difference in length to the original length. The original length is obtained by lengthening a crimped yarn, and then the second length is obtained by unloading the tensile force by allowing a predetermined time period to lapse. The difference in length is calculated based on the original and second lengths. In Test No. 3, the first kind of staple fibers was replaced with two parts of staple fibers, which were 6 denier and 4 denier. The results obtained are described in Test No. 3 in Table 1. In Test No. 4 in Table 1, the characteristics of the staple fibers were very similar to those in Test No. 3 except that the thermal shrinkage of the second kind of staple fibers constituting an intermediate portion was 20%. As a comparison, staple fibers which were the same as those utilized in Test No. 1 were randomly mixed and spun, and then the obtained spun yarn was subjected to a heat treatment. The results obtained by randomly mixing the spun yarn are described in Test No. 5 in Table 1. The first kind of staple fibers in Test No. 1 was replaced with staple fibers, each of which was 2 denier. The results obtained thereby are described in Test No. 6 in Table 1. In Test No. 7 in Table 1, the results obtained by replacing the second kind of staple fibers in Test No. 1 with staple fibers, each of which was 6 denier, are described. In Test No. 8 in Table 1, the third kind of staple fibers in Test No. 1 was replaced with staple fibers, each of which was 3 denier, and the obtained results are described therein. In Test No. 9, the difference in the thermal shrinkage between the second and third kinds of staple fibers was zero. The results obtained are illustrated in Text No. 9 in Table 1. It should be noted that in Test No. 9, the second and third kinds of staple fibers could not be separated in distinctive layers.

In Tables 1 and 2, Table 2 being explained hereinafter, ◎ denotes "superior", O denotes "good", Δ denotes "not good" and x denotes "inferior".

TABLE 1

| | UNIT | 1 | 2 | 3 | 4 |
|---|---|---|---|---|---|
| First kind of staple fibers | | POLYESTER | POLYESTER | POLYESTER | POLYESTER |
| Denier × Fiber length | DENIER × MM | 6 × 76 | 6 × 76 | 6 × 76, 4 × 64 | 6 × 76, 4 × 64 |
| Blending ratio | % | 35 | 35 | 15, 20 | 15, 20 |
| Thermal shrinkage in boiling water | % | 15 | 12 | 15, 10 | 15, 10 |
| Second kind of staple fibers | | POLYESTER | POLYESTER | POLYESTER | POLYESTER |
| Denier × Fiber length | DENIER × MM | 2 × 51 | '× 51 | 2 × 51 | 2 × 51 |
| Blending ratio | % | 35 | 35 | 35 | 35 |
| Thermal shrinkage in boiling water | % | 9 | 9 | 9 | 20 |
| Third kind of staple fibers | | POLYESTER | POLYESTER | POLYESTER | POLYESTER |
| Denier × Fiber length | DENIER × MM | 0.8 × 38 | 0.8 × 38 | 0.5 × 38 | 0.5 × 38 |
| Blending ratio | % | 30 | 30 | 30 | 30 |
| Thermal shrinkage in boiling water | % | 3 | 3 | 0 | 0 |
| Difference in thermal shrinkage in boiling water in second and third kinds of staple fibers | % | 6 | 6 | 9 | 20 |
| Hand | | | | | |
| Smooth, Limber and soft feeling | | O | O | O | O |
| Springiness and liveliness | | O | O | O | ◎ |
| Handle of bulkiness, and rich and well formed feeling | | O | ◎ | ◎ | O |
| Bulkiness | | O | ◎ | ◎ | O |

TABLE 1-continued

| Remarks | | EXAMPLE | | EXAMPLE CRIMP ELASTICITY PERCENTAGE OF 85% | EXAMPLE | EXAMPLE |
|---|---|---|---|---|---|---|
| | UNIT | 5 | 6 | 7 | 8 | 9 |
| First kind of staple fibers | | POLYESTER | POLY-ESTER | POLY-ESTER | POLYESTER | POLYESTER |
| Denier × Fiber length | DENIER × MM | 6 × 76 | 2 × 51 | 6 × 76 | 6 × 76 | 6 × 76 |
| Blending ratio | % | 35 | 35 | 35 | 35 | 35 |
| Thermal shrinkage in boiling water | % | 15 | 15 | 15 | 15 | 15 |
| Second kind of staple fibers | | POLYESTER | POLY-ESTER | POLY-ESTER | POLYESTER | POLYESTER |
| Denier × Fiber length | DENIER × MM | 2 × 51 | 2 × 51 | 6 × 76 | 2 × 51 | 2 × 51 |
| Blending ratio | % | 35 | 35 | 35 | 35 | 35 |
| Thermal shrinkage in boiling water | % | 9 | 9 | 9 | 9 | 3 |
| Third kind of staple fibers | | POLYESTER | POLY-ESTER | POLY-ESTER | POLYESTER | POLYESTER |
| Denier × Fiber length | DENIER × MM | 0.8 × 38 | 0.8 × 38 | 0.8 × 38 | 3 × 51 | 0.8 × 38 |
| Blending ratio | % | 30 | 30 | 30 | 30 | 30 |
| Thermal shrinkage in boiling water | % | 3 | 3 | 3 | 3 | 3 |
| Difference in thermal shrinkage in boiling water in second and third kinds of staple fibers | % | 6 | 6 | 6 | 6 | 0 |
| Hand | | | | | | |
| Smooth, Limber and soft feeling | | X | O | Δ | X | X |
| Springiness and liveliness | | O | X | O | O | O |
| Handle of bulkiness, and rich and well formed feeling | | O | O | Δ | O | O |
| Bulkiness | | Δ | Δ | O ~ Δ | O | Δ |
| Remarks | | COMPARISON RANDOMLY MIXED SPUN YARN | COMPAR-SON | COMPAR-ISON | COMPARISON | COMPARISON NOT MULTI-LAYERED |

EXAMPLE 2

Utilizing the various kinds of staple fibers which are described in Table 2, some of which have modified cross section, multi-layered bulky spun yarns of the present invention having a cotton count of $30/_1S$ were produced, and then twill fabrics having a construction expressed by 2/2 were manufactured and the hand thereof was measured by sensual test.

In test No. 1 in Table 2, the modified hollow fibers illustrated in FIG. 6A were used as the first part of the first kind of staple fibers, and the circular cross sectioned fibers were used as the second part of the first kind and the third kind of staple fibers. The modified hollow fibers having trilobal cross section as illustrated in FIG. 6D were used as the second kind of staple fibers.

In Test No. 2 in Table 2, the modified hollow fibers illustrated in FIGS. 6A and the trilobal cross sectioned fibers illustrated in FIG. 6E were used as the first part of the first kind of staple fibers, and the other staple fibers were the same as those in Test No. 1. In Test No. 3, the staple fivers were the same as those in Test No. 1 except that the first part of the first kind of staple fibers had latent crimp.

TABLE 2

| | UNIT | 1 | 2 | 3 |
|---|---|---|---|---|
| FIRST KIND OF STAPLE FIBERS | | | | |
| First part of staple fibers | | | | |
| Cross sectional shape | | POLYESTER FIG. 6A | POLYESTER FIG. 6A FIG. 6E | POLYESTER FIG. 6A |
| Denier × Fiber length | DENIER × MM | 6 × 76 | 6 × 76, 3 × 64 | 6 × 76 |
| Blending ratio | % | 15 | 10, 10 | 15 |
| Thermal shrinkage in boiling water | % | 10.5 | 10.5, 13.4 | 15.3 |
| Second part of staple fibers | | | | |
| Cross sectional shape | | POLYESTER CIRCULAR | POLYESTER CIRCULAR | POLYESTER CIRCULAR |
| Denier × Fiber length | DENIER × MM | 3 × 76 | 3 × 76 | 3 × 76 |
| Blending ratio | % | 15 | 10 | 15 |
| Thermal shrinkage in boiling water | % | 1.0 | 1.0 | 1.0 |
| SECOND KIND OF STAPLE FIBERS | | | | |
| Cross sectional shape | | POLYESTER FIG. 6D | POLYESTER FIG. 6D | POLYESTER FIG. 6D |
| Denier × Fiber length | DENIER × MM | 2.5 × 51 | 2.5 × 51 | 2.5 × 51 |
| Blending ratio | % | 30 | 30 | 30 |
| Thermal shrinkage in boiling water | % | 12.5 | 12.5 | 12.5 |
| THIRD KIND OF STAPLE FIBERS | | | | |
| Cross sectional form | | POLYESTER CIRCULAR | POLYESTER CIRCULAR | POLYESTER CIRCULAR |
| Denier × Fiber length | DENIER × MM | 0.8 × 38 | 0.8 × 38 | 0.8 × 38 |
| Blending ratio | % | 40 | 40 | 40 |
| Thermal shrinkage in boiling water | % | 0.5 | 0.5 | 0.5 |
| Hand | | | | |
| Smooth, Limber and soft feeling | | O | O | O |
| Springiness and liveliness | | O | O | O |

TABLE 2-continued

| | UNIT | 1 | 2 | 3 |
|---|---|---|---|---|
| Handle of bulkiness, and rich and well formed feeling | | ◎ | | |
| Bulkiness | | ◎ | | ◎ |

What we claim is:

1. A bulky spun yarn comprising at least three kinds of staple fibers which vary in denier characterized in that said at least three kinds of staple fibers are coaxially layered about the axis of said spun yarn, and a first kind of staple fibers, each of which is the largest in denier, is located at the core portion of said spun yarn so as to constitute an innermost portion, and that a second kind of staple fibers, each of which is a smaller denier than that of said first kind of staple fibers, surrounds said innermost portion so as to constitute an intermediate portion, and that a third kind of staple fibers, each of which is the smallest in denier, surrounds said intermediate portion so as to constitute an outermost portion.

2. A bulky spun yarn according to claim 1, characterized in that said innermost portion is formed from at least two kinds of staple fibers which vary in denier.

3. A bulky spun yarn according to claim 2 comprising at least four kinds of staple fibers which vary in denier and cross section, characterized in that said at least four kinds of staple fibers are coaxially layered about the axis of said spun yarn, each fiber in a first part of said first kind of staple fibers located at the core portion of said spun yarn so as to constitute an innermost portion is at least 3 denier and has a modified cross section, and each fiber in a second part of said first kind of staple fibers located just outside of said innermost portion is at least 3 denier but is smaller than that of said first part of said first kind of staple fibers, each fiber in said second staple fibers located just outside of said first kind of staple fibers is at most 4 denier and has a modified cross section, and said third kind of staple fibers located just outside of said second kind of staple fibers is constituted with very fine fibers, each of which is at most 1.5 denier, whereby said spun yarn has a large bulk.

4. A bulky spun yarn according to claim 3, characterized in that said first part of said first kind and second kind of staple fibers are made of a thermoplastic synthetic material.

5. A bulky spun yarn according to claim 1, characterized in that said first kind of staple fibers is at least 3 denier, said second kind of said staple fibers is between 1.5 denier and 3 denier, and said third kind of staple fibers is at most 1.5 denier.

6. A bulky spun yarn according to claim 1, characterized in that said at least three kinds of staple fibers are made of a thermoplastic synthetic material.

7. A bulky spun yarn according to claim 1, characterized in that at least one of said three kinds of staple fibers has a modified cross section.

8. A process for manufacturing a bulky spun yarn comprising at least three kinds of staple fibers which vary in denier and which are coaxially layered about the axis of said spun yarn, which process is characterized in that, during a roving operation, a roving which comprises a first kind of staple fibers, each of which has the largest denier is supplied onto a randomly mixed sliver so as to be interposed with said randomly mixed sliver which comprises a second kind of staple fibers, each of which is a smaller denier than that of said first kind of staple fibers, and a third kind of staple fibers, each of which has the smallest denier, the thermal shrinkage of said second kind of staple fibers being higher than that of said third kind of staple fibers, and then said roving is twisted about the axis thereof so that said randomly mixed sliver is wrapped around said roving to form a double layered roving, and, after said double layered roving is subjected to a fine spinning operation, said fine spun yarn is subjected to a heat treatment.

9. A process according to claim 8, characterized in that each fiber in said first kind of staple fibers constituting said roving is at least 3 denier, each fiber in said second kind of staple fibers in said randomly mixed sliver is between 1.5 denier and 3 denier and each fiber in said third kind of staple fibers is of at most 1.5 denier.

10. A process according to claim 9, characterized in that said randomly mixed sliver comprises: said second kind of staple fibers, each of which is between 1.5 denier and 3 denier, and said third kind of very fine staple fibers, each of which is at most 1.5 denier, and that said thermal shrinkage in boiling water of said second kind of staple fibers is at least 3 percent higher than that of said third kind of staple fibers.

11. A process according to claim 8, characterized in that said first kind of staple fibers constituting said roving comprises at least two parts of staple fibers which vary in thermal shrinkage properties.

12. A process according to claim 11, characterized in that said roving comprises a first part of staple fibers, each of which is at least 3 denier and has a modified cross section, and a second part of staple fibers, each of which is at least 3 denier but is smaller than that of said first part, the thermal shrinkage of said first part of staple fibers being higher than that of said second part of staple fibers, each fiber in said second kind of staple fibers constituting said randomly mixed sliver is at most 4 denier and has a modified cross section, and each fiber in said third kind of staple fibers also constituting said randomly mixed sliver is at most 1.5 denier, the thermal shrinkage of said second kind of staple fibers being smaller than that of said third kind of staple fibers.

13. A process according to claim 12, characterized in that said thermal shrinkage in boiling water of said first part of staple fibers having a modified cross section and constituting said roving is at least 3 percent higher that of said second part of staple fibers.

14. A process according to claim 12, characterized in that said thermal shrinkage in boiling water of said second kind of staple fibers is 3 percent than that of said third kind of staple fibers.

15. A process according to claim 8, characterized in that said fine spun yarn is subjected to a heat treatment in a dry condition at a temperature between 130° C. and 200° C.

16. A process according to claim 8, characterized in that said fine spun yarn is subjected to a heat treatment in a wet condition at a temperature between 80° C. and 130° C.

* * * * *

UNITED STATES PATENT AND TRADEMARK OFFICE

CERTIFICATE OF CORRECTION

PATENT NO. : 4,263,777

DATED : April 28, 1981

INVENTOR(S) : Osamu Wada; Goro Murata

It is certified that error appears in the above—identified patent and that said Letters Patent is hereby corrected as shown below:

In the Title page, under Inventor Information: after "Takatsuki" insert --Osaka--.

Column 6, line 37: "is" should be --are--.

Column 7, line 41: "dimethyl vinylpolysioxanes" should be --dimethyl polysiloxanes--.

line 42: "methylbinylpolipiloxanes" should be --methylvinylpolysiloxanes--.

line 44: "to equal to" should be --be equal to--.

Column 10, Table 1, under heading "2", 6 lines down from top: "' x 51" should be --2 x 51--.

Column 12, Table 1, under heading "6", last two lines at bottom: "COMPAR-" SON should be -- COMPARI- SON --.

Column 12, line 43: "fivers" should read --fibers--.

UNITED STATES PATENT AND TRADEMARK OFFICE

CERTIFICATE OF CORRECTION

PATENT NO. : 4,263,777

DATED : April 28, 1981

INVENTOR(S) : Osamu Wada; Goro Murata

It is certified that error appears in the above—identified patent and that said Letters Patent is hereby corrected as shown below:

Column 14, Table 2, the 2 lines under headings "1", "2" and "3" are incorrect and should read as follows:

| 1 | 2 | 3 |
|---|---|---|
| o | ◎ | o |
| o | ◎ | ◎ |

Claim 3, lines 16-17, "constituted with" should be --constituted of--.

Claim 13, line 4, "higher that" should be --higher than that--.

Signed and Sealed this

Twentieth Day of October 1981

[SEAL]

Attest:

GERALD J. MOSSINGHOFF

Attesting Officer

Commissioner of Patents and Trademarks